US006783908B2

(12) United States Patent
Srinivasan et al.

(10) Patent No.: US 6,783,908 B2
(45) Date of Patent: Aug. 31, 2004

(54) SURFACE-TREATED TONER PARTICLES, PROCESS FOR FORMING, AND ELECTROSTATOGRAPHIC DEVELOPER CONTAINING SAME

(75) Inventors: Satyanarayan Ayangar Srinivasan, Pittsford, NY (US); Dinesh Tyagi, Fairport, NY (US)

(73) Assignee: NexPress Solutions, LLC, Rochester, NY (US)

( * ) Notice: Subject to any disclaimer, the term of this patent is extended or adjusted under 35 U.S.C. 154(b) by 133 days.

(21) Appl. No.: 10/151,332

(22) Filed: May 20, 2002

(65) Prior Publication Data

US 2003/0215730 A1 Nov. 20, 2003

(51) Int. Cl.[7] ..... G03G 9/00

(52) U.S. Cl. ..... 430/108.3; 430/108.7; 430/137.21

(58) Field of Search ..... 430/108.3, 108.7, 430/137.21

(56) References Cited

U.S. PATENT DOCUMENTS

| | | | | |
|---|---|---|---|---|
| 4,920,023 A | | 4/1990 | Koch et al. | |
| 5,248,581 A | | 9/1993 | Nakayama et al. | |
| 5,486,420 A | | 1/1996 | Nishihara et al. | |
| 5,510,220 A | | 4/1996 | Nash et al. | |
| 5,700,616 A | | 12/1997 | Kasuya et al. | |
| 5,702,858 A | | 12/1997 | Yuasa et al. | |
| 5,789,131 A | | 8/1998 | Mikuriya et al. | |
| 5,827,632 A | | 10/1998 | Inaba et al. | |
| 6,197,466 B1 | | 3/2001 | Fields | |
| 6,333,132 B1 | * | 12/2001 | Tomura | 430/108.7 |
| 6,503,675 B1 | * | 1/2003 | Kabai | 430/108.3 |

* cited by examiner

*Primary Examiner*—Mark A. Chapman

(57) ABSTRACT

An electrostatographic toner composition consists essentially of noncrosslinked linear polymeric toner particles, about 0.7 wt. % to about 4 wt. % of hydrophobic silica particles disposed on the surface of the toner particles, and about 0.1 wt. % to about 2 wt. % of particles of a fatty acid metal salt disposed on the surface of the toner particles, wherein the weight percentages of the hydrophobic silica particles and the particles of a fatty acid metal salt are based on the weight of the polymeric toner particles. An electrostatographic developer is formed by mixing the toner composition so prepared with hard magnetic carrier particles. A process for forming an electrostatographic toner composition comprises: providing noncrosslinked polymeric toner particles of a selected particle size, and dry blending the polymeric toner particles with a mixture consisting essentially of about 0.7 wt. % to about 4 wt. % of hydrophobic silica particles and about 0.1 wt. % to about 2 wt. % of particles of a fatty acid metal salt, thereby forming a toner composition wherein the silica and fatty acid metal salt particles are disposed on the surface of the toner particles.

45 Claims, No Drawings

SURFACE-TREATED TONER PARTICLES, PROCESS FOR FORMING, AND ELECTROSTATOGRAPHIC DEVELOPER CONTAINING SAME

FIELD OF THE INVENTION

This invention relates generally to electrostatographic imaging and, more particularly, to electrostatographic compositions comprising toner particles surface-treated with a mixture of silica particles and particles of a metal salt of an aliphatic acid, and further to a process for forming the toner particles.

BACKGROUND OF THE INVENTION

Digital electrostatographic printing products are being developed for printing high quality text and half tone images (cf. Schinichi Sata, et al., "Study on the Surface Properties of Polyester Color Toner," IS&T NIP13, 1997, pp 149–152, and Nash, R. and Muller, R. N. "The Effect of Toner and Carrier Composition on the Relationship Between Toner Charge to Mass Ratio and Toner Concentration," IS&T NIP 13, 1997, pp 112–120); thus there is a need to formulate electrostatographic toners and developers that produce improved image quality. Surface treatment of toners with fumed silica and/or titanium dioxide powders results in toner and developer formulations that have improved powder flow properties and reproduce text and half tone dots more uniformly without character voids (cf. Schinichi Sata, et. al., supra). The improved powder fluidity of the toner or developer can, however, produce unwanted print density in white background areas.

Over the "life" of an electrostatographic developer, its triboelectric charging characteristics change as prints are made. This instability in charging level is one of the factors that require active process control systems in electrostatographic printers to maintain consistent image-density from print to print.

There is a need in the art for developers that have improved stability and provide the advantages of improved electrostatic transfer and higher density capabilities.

In electrography, an electrostatic charge image is formed on a dielectric surface, typically the surface of the photoconductive recording element. Development of this image is typically achieved by contacting it with a two-component developer comprising a mixture of pigmented resinous particles, known as toner, and magnetically attractable particles, referred to as carrier. The carrier particles serve as sites against which the non-magnetic toner particles can impinge and thereby acquire a triboelectric charge opposite to that of the electrostatic image. During contact between the electrostatic image and the developer mixture, the toner particles are stripped from the carrier particles to which they were formerly triboelectrically adhered by the relatively strong electrostatic forces associated with the charge image. In this manner, the toner particles are deposited on the electrostatic image to render it visible.

It is generally known to apply developer compositions of the above type to electrostatic images by means of a magnetic applicator that comprises a cylindrical sleeve of non-magnetic material having a magnetic core positioned within. The core usually comprises a plurality of parallel magnetic strips arranged around the core surface to present alternating north and south oriented magnetic fields. These fields project radially through the sleeve and serve to attract the developer composition to the sleeve outer surface, thereby forming what is commonly referred to in the art as a "brushed nap". Either or both of the cylindrical sleeve and the magnetic core are rotated with respect to each other to cause the developer to advance from a supply sump to a position in which it contacts the electrostatic image to be developed. After development, the toner depleted carrier particles are returned to the sump for toner replenishment.

Conventionally, carrier particles made of soft magnetic materials have been employed to carry and deliver the toner particles to the electrostatic image. U.S. Pat. Nos. 4,546,060, 4,473,029 and 5,376,492, the disclosures of which are incorporated herein by reference in their entirety, teach the use of hard magnetic materials as carrier particles and also apparatus for the development of electrostatic images utilizing such hard magnetic carrier particles. These patents require that the carrier particles comprise a "hard" magnetic material exhibiting a coercivity of at least 300 Oersteds when magnetically saturated, and an induced magnetic moment of at least 20 EMU/gm when in an applied magnetic field of 1000 Oersteds. When referring to magnetic materials, the terms "hard" and "soft" have the generally accepted meaning indicated on page 18 of B. D. Cullity, *Introduction To Magnetic Materials*, Addison-Wesley Publishing Company, 1972. Hard magnetic carrier materials represent a great advance over the use of soft magnetic carrier materials in that the speed of development is remarkably increased, accompanied by good image development. Speeds as high as four times the maximum speed utilized in the use of soft magnetic carrier particles have been demonstrated.

In the methods taught by the foregoing patents, the developer is moved at essentially the same speed and direction as the electrostatic image to be developed by high speed rotation of the multi-pole magnetic core within the sleeve, the developer being disposed on the outer surface of the sleeve. Rapid pole transitions on the sleeve are mechanically resisted by the carrier because of its high coercivity. The toner particles disposed on the surface of the carrier particles that comprise the brushed nap of the carrier rapidly "flip" on the sleeve in order to align themselves with the magnetic field reversals imposed by the rotating magnetic core; and as a result, they move with the toner on the sleeve through the development zone in contact with or in close relationship to the electrostatic image on a photoconductor. This process is discussed in, for example, U.S. Pat. No. 4,531,832, the disclosure of which is incorporated herein by reference.

The rapid pole transitions, for example, as many as 600 per second on the sleeve surface when the magnetic core is rotated at a speed of 2000 rpm, create a highly energetic and vigorous movement of developer as it moves through the development zone. This vigorous action constantly recirculates the toner to the sleeve surface and then back to the outside of the nap to provide toner for development. This flipping action also results in a continuous feed of fresh toner particles to the image. As described in the above-mentioned patents, this method provides high density, high quality images at relatively high development speeds.

The direct interaction of the developer nap with the image member causes the developer to roll back toward the input side of the development zone. This rollback broadens the contact between the developer and the image member and thereby improves the development completion of the system.

The above-described development systems utilizing such hard magnetic carrier developers can have a tendency to display an increasing amount of "dusting" over time during use. The dusting phenomenon occurs when toner particles having a relatively low charge to mass (q/m) are literally flung off the developer nap of the rotating magnetic core toning roller. The rather violent chain flipping action characteristic of these development systems is believed to contribute to the dusting problem. While not wishing to be bound by theory, the mechanism thought to be responsible for such dusting is that the rate of charging of fresh replenisher toner decreases as a result of the loss of carrier charging ability by factors such as, for example, scum and fines buildup.

SUMMARY OF THE INVENTION

The present invention is directed to an electrostatographic toner composition that consists essentially of: noncrosslinked linear polymeric toner particles, about 0.7 wt. % to about 4 wt. % of hydrophobic silica particles disposed on the surface of the toner particles, and about 0.1 wt. % to about 2 wt. % of particles of a fatty acid metal salt disposed on the surface of the toner particles, wherein the weight percentages of the hydrophobic silica particles and the particles of a fatty acid metal salt are based on the weight of the polymeric toner particles. An electrostatographic developer is formed by mixing the toner composition so formed with hard magnetic carrier particles.

The present invention is further directed to a process for forming an electrostatographic toner composition that comprises: providing noncrosslinked linear polymeric toner particles of a selected particle size, and dry blending the polymeric toner particles with a mixture consisting essentially of about 0.7 wt. % to about 4 wt. % of hydrophobic silica particles and about 0.1 wt. % to about 2 wt. % of particles of a fatty acid metal salt, thereby forming a toner composition wherein the hydrophobic silica particles and particles of a fatty acid metal salt are disposed on the surface of the toner particles.

DETAILED DESCRIPTION OF THE INVENTION

Electrostatographic developers made from toner particles surface treated with both silica and an aliphatic acid metal salt in accordance with the present invention exhibit lower charge characteristics as compared to those from toner particles that were treated with only ultrafine fumed silica. The toner particle compositions of the present invention also exhibit lower dusting characteristics compared to toner particles surface-treated with only a metal salt of an aliphatic acid.

Formulations have been previously described for toner particles treated with silica, as taught in U.S. Pat. Nos. 5,700,616, 5,827,632, 5,789,131, 5,702,858, and 5,486,420; with salts of fatty acids, as taught in U.S. Pat. No. 4,920,023; and with silica core particles coated with salts of fatty acids, as taught in U.S. Pat. No. 5,248,581, the disclosures of all of which are incorporated herein by reference.

U.S. Pat. No. 5,510,220, the disclosure of which is incorporated herein by reference, describes a developer composition containing negatively charged toner particles consisting essentially of crosslinked polyester resin particles, pigment particles, and a surface additive mixture comprising about 0.2 to about 0.5 wt. % each of a fatty acid metal salt and of nonmetallized silica particles, and about 0.3 to about 1 wt. % of a metal oxide such as titanium dioxide; and carrier particles comprising a core coated with a conductive component.

A toner composition of the present invention consists essentially of: polymeric toner particles, about 1 wt. % of hydrophobic silica particles disposed on the surface of the toner particles, and about 0.1 wt. % to about 2 wt. % of particles of a fatty acid metal salt disposed on the surface of the toner particles. Preferably, the toner composition contain at least 0.5 wt. %, more preferably, at least about 1 wt. %, most preferably, at least about 1.5 wt. % of the fatty acid metal salt particles, based on the weight of the polymeric toner particles. Surface treatment of the toner particles in accordance with the present invention can lower the charge and maintain lower dusting characteristics of a developer containing the resulting toner particle composition. The toner particles so obtained are combined with hard magnetic carrier particles to form, in accordance with the present invention, developer compositions especially useful for full color digital printing. The carrier particles included in the developer composition are preferably hard magnetic ferrite particles coated with an insulating resin.

The toner particles and developers of the present invention differ in several important respects from those described in the above-discussed U.S. Pat. No. 5,510,220. For example, the toner particles of the present invention are formed from a noncrosslinked linear polymer, which is preferred for the formation of full color images, and contain no metal oxide particles, which would have an adverse effect on development efficiency. Furthermore, the developers of the present invention include, in addition to the described toner particles, hard magnetic carrier particles, preferably hard magnetic ferrite particles coated with an insulating resin, and are characterized by very high resistivity, about $10^{12}$ ohm-cm to about $10^{15}$ ohm-cm.

The term "dusting characteristics" as used herein, refers to the amounts of uncharged or low charged particles that are produced when fresh replenishment toner is mixed in with aged developer. Developers that result in very low dust levels are desirable. In a printer, replenishment toner is added to the developer station to replace toner that is removed in the process of printing copies, as described in, for example, U.S. Pat. Nos. 3,938,992 and 3,944,493, the disclosures of which are incorporated herein by reference. This added fresh toner is uncharged and gains a triboelectric charge by mixing with the developer. During this mixing process, uncharged or low charged particles can become airborne and result in background on prints or dust contamination within the printer. A "dusting test" is described hereinbelow to evaluate the potential for a replenishment toner to form background or dust.

The term "low charge characteristics" as used herein refers to the ratio of charge to mass of the toner in a developer. Low charged toners are easier to transport through the electrostatographic process, for example, from the developer station to the photoconductor, from the photoconductor onto paper, etc. Low charge is particularly important in multi-layer transfer processes in color printers because it allows the voltage above already transferred layers to be minimized, thereby facilitating the transfer of subsequent layers of toner. However, typically low charge toners also undesirably result in significant dusting. Developers that result in very low dust levels are desirable. Typically toners that exhibit high charge to mass ratios exhibit low levels of dust, and vice-versa. Toners that exhibit both low charge to mass ratios and low dust characteristics would be very desirable. For an 8 $\mu$m (volume average) particle size toner, a desirable charge to mass would be less than about 50 $\mu$C/g, preferably, about 20–40 $\mu$C/g.

Toner particles in a composition of the present invention can be made from a noncrosslinked linear polymeric binder, with or without a colorant, and with or without a charge control agent. The binder polymer can be selected from among polyesters and vinyl addition polymers; a preferred binder polymer is a polyester derived from bis-phenol A. An exemplary toner particle formulation is shown in TABLE 1.

TABLE 1

Toner Particle Components

| Component | Parts by Weight | Supplier |
|---|---|---|
| Propoxylated Bisphenol A-fumaric acid | 100 | Reichhold Chemicals Inc. |
| Copper phthalocyanine, Pigment Blue, 15:3 LUPRETON BLUE SE1163 ™ | 5 | BASF Corporation |
| Charge Control Agent; Al or Zn salts of di-t-butylsalicylic acid | 2 | Orient Chemical Corporation |

The components were powder blended, melt compounded, ground in an air jet mill, and classified by particle size. The resulting toner has a median volume average particle size, as determined by a Coulter Counter, of preferably about 2 μm to about 20 μm more preferably, about 4 μm to about 10 μm , most preferably, about 7.5 μm to about 8.5 μm, and a specific surface area of 0.7–0.8 $m^2$/mL.

In one embodiment of the invention, electrostatographic toner polymer particles having a narrow size distribution can be prepared by means of an organic solvent/aqueous chemical process frequently referred to as a "limited coalescence" (LC process). In the practice of this technique, toner particles are prepared from any type of polymer that is soluble in a solvent that is immiscible with water. Thus, the size and distribution of the resulting particles can be predetermined and controlled by the relative quantities of the particular polymer employed, the solvent, the quantity and size of the water insoluble solid particulate suspension stabilizer, typically silica or latex, and the size to which the solvent-polymer droplets are reduced by agitation.

Limited coalescence techniques of this type have been described in numerous patents pertaining to the preparation of electrostatic toner particles because such techniques typically result in the formation of toner particles having a substantially uniform size distribution. Representative limited coalescence processes employed in toner preparation are described in U.S. Pat. Nos. 4,833,060 and 4,965,131 to Nair et al., the disclosures of which are incorporated herein by reference. The method involves dissolving a polymer material in an organic solvent and, optionally, a pigment and a charge control agent to form an organic phase; dispersing the organic phase in an aqueous phase comprising a particulate stabilizer and homogenizing the mixture; evaporating the solvent, and washing and drying the resultant product.

Examples of fumed inorganic oxides that can be used for toner particle surface treatment are listed in TABLE 2. Hydrophobic silica particles useful in the present invention preferably have a particle size of about 0.005 μm to about 0.05 μm and a surface area of about 30 $m^2$/g to about 450 m /g. The hydrophobic silica particles preferably are disposed on the surface of the toner particles in an amount equal to about 0.1 wt. % to about 10 wt. % of the amount of the toner particles.

TABLE 2

Inorganic Oxides for Toner Particle Surface Treatment

| Inorganic Oxide | Name | BET surface area ($m^2$/g) | Avg. Primary Particle Size (nm) | Reagent | Supplier |
|---|---|---|---|---|---|
| Ultrafine Silica | R972 | 130 ± 25 | 16–18 | Dichlorodimethylsilane | Degussa |
| Ultrafine Silica | RY200 | 100 ± 20 | 11–13 | Polydimethylsiloxane | Degussa |
| Ultrafine Silica | RY300 | 200 ± 20 | 6–8 | Polydimethylsiloxane | Degussa |
| Ultrafine Titanium Dioxide | T805 | 50 ± 15 | 20–30 | Octyltrimethoxysilane | Degussa |
| Ultrafine Titanium Dioxide | MPT313 | 90 ± 15 | 7–12 | Hexyltrimethoxysilane | Ishihara Sangyo Kaisha Ltd. |

Some salts of fatty acids that can be employed for toner particle surface treatment are listed in TABLE 3. Preferably, the particles of the fatty acid metal salt have a particle size of about 0.5 μm to about 3 μm and are disposed on the surface of the toner particles in an amount equal to about 10 wt. % to about 500 wt. % of the amount of the hydrophobic silica particles.

TABLE 3

Salts of Fatty Acids for Toner Particle Surface Treatment

| Trade Name | Name | Metal content % | Average Particle Size* (μm) | Melting Point (° C.) | Supplier |
|---|---|---|---|---|---|
| MCA-2 | Calcium stearate | 6.5–7 | 0.5–1 | 145–160 | Nagase America |
| MZN-2 | Zinc steareate | 10.5–11.5 | 0.7–1.5 | 116–125 | Nagase America |

*By laser diffraction in water

In the following examples, components of polyester toners containing a binder polymer formed from propoxylated bisphenol-A and fumaric acid were powder blended, melt compounded, ground in an air jet mill, and classified by particle size. The resulting toner particles had a median volume average particle size in the range of about 7.8 μm to about 8.5 μm. The toner particles were subsequently surface treated by dry blending 25 grams of toner particles with varying amounts of surface treatment agents for 30 to 60 seconds using a high speed mixer such as, for example, a high-speed lab scale Waring mixer.

TABLE 4 lists the components of toner compositions in Comparative Examples 1–19. Example 1 has no surface treatment of the toner particles; in Examples 2–18, the particles have been treated with a single material selected from among calcium and zinc stearate, ultrafine silica, and ultrafine titanium dioxide.

TABLE 5 lists the components of toner compositions in Inventive Examples 19–45. All of these examples are surface treated with a combination of calcium stearate and one of three ultrafine silicas. Similarly, TABLE 6 lists the components of toner compositions in Inventive Examples 46–72, all of which are surface treated with a combination of zinc stearate and one of the ultrafine silicas.

In TABLE 7 is listed the components of toner compositions in Comparative Examples 73–82, all of which are surface treated with a combination of calcium stearate and one of two ultrafine titanium dioxide materials.

TABLE 4

Comparative Examples of Surface-treated Toners

| Comparative Example | Toner (g) | MCA-2 (g) | MZN-2 (g) | Silica R972 (g) | Silica RY200 (g) | Silica RY300 (g) | T805 (g) | MPT313 (g) |
|---|---|---|---|---|---|---|---|---|
| 1 | 25 | 0 | 0 | 0 | 0 | 0 | 0 | 0 |
| 2 | 25 | 0.05 | 0 | 0 | 0 | 0 | 0 | 0 |
| 3 | 25 | 0.1 | 0 | 0 | 0 | 0 | 0 | 0 |
| 4 | 25 | 0.125 | 0 | 0 | 0 | 0 | 0 | 0 |
| 5 | 25 | 0.25 | 0 | 0 | 0 | 0 | 0 | 0 |
| 6 | 25 | 0.375 | 0 | 0 | 0 | 0 | 0 | 0 |
| 7 | 25 | 0.5 | 0 | 0 | 0 | 0 | 0 | 0 |
| 8 | 25 | 0 | 0.05 | 0 | 0 | 0 | 0 | 0 |
| 9 | 25 | 0 | 0.1 | 0 | 0 | 0 | 0 | 0 |
| 10 | 25 | 0 | 0.125 | 0 | 0 | 0 | 0 | 0 |
| 11 | 25 | 0 | 0.25 | 0 | 0 | 0 | 0 | 0 |
| 12 | 25 | 0 | 0.375 | 0 | 0 | 0 | 0 | 0 |
| 13 | 25 | 0 | 0.5 | 0 | 0 | 0 | 0 | 0 |
| 14 | 25 | 0 | 0 | 0.25 | 0 | 0 | 0 | 0 |
| 15 | 25 | 0 | 0 | 0 | 0.25 | 0 | 0 | 0 |
| 16 | 25 | 0 | 0 | 0 | 0 | 0.25 | 0 | 0 |
| 17 | 25 | 0 | 0 | 0 | 0 | 0 | 0.25 | 0 |
| 18 | 25 | 0 | 0 | 0 | 0 | 0 | 0 | 0.25 |

TABLE 5

Inventive Examples of Surface-treated Toners

| Inventive Example | Toner (g) | MCA-2 (g) | Silica R972 (g) | Silica RY200 (g) | Silica RY300 (g) |
|---|---|---|---|---|---|
| 19 | 25 | 0.025 | 0.25 | 0 | 0 |
| 20 | 25 | 0.0625 | 0.25 | 0 | 0 |
| 21 | 25 | 0.075 | 0.25 | 0 | 0 |
| 22 | 25 | 0.1 | 0.25 | 0 | 0 |
| 23 | 25 | 0.125 | 0.25 | 0 | 0 |
| 24 | 25 | 0.1875 | 0.25 | 0 | 0 |
| 25 | 25 | 0.25 | 0.25 | 0 | 0 |
| 26 | 25 | 0.375 | 0.25 | 0 | 0 |
| 27 | 25 | 0.5 | 0.25 | 0 | 0 |
| 28 | 25 | 0.025 | 0 | 0.25 | 0 |
| 29 | 25 | 0.0625 | 0 | 0.25 | 0 |
| 30 | 25 | 0.075 | 0 | 0.25 | 0 |
| 31 | 25 | 0.1 | 0 | 0.25 | 0 |
| 32 | 25 | 0.125 | 0 | 0.25 | 0 |
| 33 | 25 | 0.1875 | 0 | 0.25 | 0 |
| 34 | 25 | 0.25 | 0 | 0.25 | 0 |
| 35 | 25 | 0.375 | 0 | 0.25 | 0 |
| 36 | 25 | 0.5 | 0 | 0.25 | 0 |
| 37 | 25 | 0.025 | 0 | 0 | 0.25 |
| 38 | 25 | 0.0625 | 0 | 0 | 0.25 |
| 39 | 25 | 0.075 | 0 | 0 | 0.25 |
| 40 | 25 | 0.1 | 0 | 0 | 0.25 |
| 41 | 25 | 0.125 | 0 | 0 | 0.25 |
| 42 | 25 | 0.1875 | 0 | 0 | 0.25 |
| 43 | 25 | 0.25 | 0 | 0 | 0.25 |
| 44 | 25 | 0.375 | 0 | 0 | 0.25 |
| 45 | 25 | 0.5 | 0 | 0 | 0.25 |

TABLE 6

Inventive Examples of Surface-treated Toners

| Inventive Example | Toner (g) | MZN-2 (g) | Silica R972 (g) | Silica RY200 (g) | Silica RY300 (g) |
|---|---|---|---|---|---|
| 46 | 25 | 0.025 | 0.25 | 0 | 0 |
| 47 | 25 | 0.0625 | 0.25 | 0 | 0 |
| 48 | 25 | 0.075 | 0.25 | 0 | 0 |
| 49 | 25 | 0.1 | 0.25 | 0 | 0 |
| 50 | 25 | 0.125 | 0.25 | 0 | 0 |

TABLE 6-continued

Inventive Examples of Surface-treated Toners

| Inventive Example | Toner (g) | MZN-2 (g) | Silica R972 (g) | Silica RY200 (g) | Silica RY300 (g) |
|---|---|---|---|---|---|
| 51 | 25 | 0.1875 | 0.25 | 0 | 0 |
| 52 | 25 | 0.25 | 0.25 | 0 | 0 |
| 53 | 25 | 0.375 | 0.25 | 0 | 0 |
| 54 | 25 | 0.5 | 0.25 | 0 | 0 |
| 55 | 25 | 0.025 | 0 | 0.25 | 0 |
| 56 | 25 | 0.0625 | 0 | 0.25 | 0 |
| 57 | 25 | 0.075 | 0 | 0.25 | 0 |
| 58 | 25 | 0.1 | 0 | 0.25 | 0 |
| 59 | 25 | 0.125 | 0 | 0.25 | 0 |
| 60 | 25 | 0.1875 | 0 | 0.25 | 0 |
| 61 | 25 | 0.25 | 0 | 0.25 | 0 |
| 62 | 25 | 0.375 | 0 | 0.25 | 0 |
| 63 | 25 | 0.5 | 0 | 0.25 | 0 |
| 64 | 25 | 0.025 | 0 | 0 | 0.25 |
| 65 | 25 | 0.0625 | 0 | 0 | 0.25 |
| 66 | 25 | 0.075 | 0 | 0 | 0.25 |
| 67 | 25 | 0.1 | 0 | 0 | 0.25 |
| 68 | 25 | 0.125 | 0 | 0 | 0.25 |
| 69 | 25 | 0.1875 | 0 | 0 | 0.25 |
| 70 | 25 | 0.25 | 0 | 0 | 0.25 |
| 71 | 25 | 0.375 | 0 | 0 | 0.25 |
| 72 | 25 | 0.5 | 0 | 0 | 0.25 |

TABLE 7

Comparative Examples of Surface-treated Toners

| Comparative Example | Toner (g) | MCA-2 (g) | T805 (g) | MPT313 (g) |
|---|---|---|---|---|
| 73 | 25 | 0.0625 | 0.25 | 0 |
| 74 | 25 | 0.125 | 0.25 | 0 |
| 75 | 25 | 0.1875 | 0.25 | 0 |
| 76 | 25 | 0.25 | 0.25 | 0 |
| 77 | 25 | 0.5 | 0.25 | 0 |
| 78 | 25 | 0.0625 | 0 | 0.25 |
| 79 | 25 | 0.125 | 0 | 0.25 |
| 80 | 25 | 0.1875 | 0 | 0.25 |
| 81 | 25 | 0.25 | 0 | 0.25 |
| 82 | 25 | 0.5 | 0 | 0.25 |

Formulation of Developers and Measurement of Charging and Dusting Characteristics In accordance with the present invention, the described toner compositions are combined with hard magnetic carrier particles, preferably hard magnetic ferrite particles coated with an insulating resin. The resulting developers are characterized by resistivity values of, preferably, about $10^{12}$ ohm-cm to about $10^{15}$ ohm-cm, more preferably, about $10^{14}$ ohm-cm to about $10^{15}$ ohm-cm.

Electrostatographic developers were prepared by mixing the toner compositions in each of TABLES 4, 5, 6, and 7 with hard magnetic ferrite carrier particles coated with a resin such as, for example, a silicone resin type polymer, poly(vinylidene fluoride), poly(methyl methacrylate), or a mixture of poly(vinylidene fluoride) and poly(methyl methacrylate). The developers were made at a concentration of 8 wt. % toner and 92 wt. % carrier particles coated with a silicone resin.

Each of the developers was mixed on a device that simulated the mixing that occurs in a printer developer station to charge the toner particles. The triboelectric charge of the toner was then measured after 2, 10, and 60 minutes of mixing. The developer was subsequently stripped of all toner and rebuilt with fresh toner. The triboelectric charge of the toner was then measured after 2 and 10 minutes of mixing.

In a printer, replenishment toner is added to the developer station to replace toner that is removed in the process of printing copies. This toner is uncharged and gains a triboelectric charge by mixing with the developer. During this mixing process uncharged or low charged particles can become airborne and result in background on prints or dust contamination within the printer.

A "dusting test" was devised to evaluate the potential for a replenishment toner to form background or dust. The developer sample was exercised on a rotating shell and magnetic core developer station. After 10 minutes of exercising, uncharged replenishment toner was added to the developer. A fine filter over the developer station then captured airborne dust that was generated when the replenishment toner was added, and the dust collected was weighed. The amount of dust was measured after 10 minutes of exercising as milligrams of toner that dusts off per gram of admixed fresh toner. After the developer had been stripped of all toner and rebuilt with fresh toner, the amount of dust was again measured after 10 minutes of exercising as milligrams of toner that dusts off per gram of admixed fresh toner.

The lower the value for this "dust" measurement, the better the toner performance. Low values of dust, less than 10 milligrams per gram of fresh added toner, in addition to low levels of toner charge (less than about 50 $\mu$C/g, preferably about 20–40 $\mu$C/g) are considered to be desirable characteristics. In TABLES 8, 9, 10, and 11 are tabulated the results of the tribocharge and replenishment dust rate tests for developers prepared from the toner compositions of, respectively, TABLES 4, 5, 6, and 7. The tabulated values correspond to the 2-minute, 10-minute and the 1-hour charge-to-mass in $\mu$C/g and the percentage of toner developed (% TC) of the fresh developer, the 2-minute and 10-minute charge-to-mass in $\mu$C/g and the percentage of toner developed (% TC) of the rebuilt developer and the fresh and rebuilt admix dust values of the fresh and aged developers.

Measurement results for developers containing the toner compositions of Comparative Examples 1–18 are provided in TABLE 8. In the evaluation of the rebuilt developer containing the toner composition of Example 1, which has no surface treatment, the rebuilt developer had a 10-minute charge-to-mass of −55 $\mu$C/g and a zero dust level.

Comparative Examples 2 to 7 have toner particles surface treated with different concentrations of calcium stearate, MCA-2. Comparative Examples 8 to 13 have particles surface treated with different concentrations of zinc stearate, MZN-2. As shown in TABLE 8, the developers of both series exhibited extremely high dust characteristics.

Comparative Examples 14, 15 and 16 contain toner particles surface treated with silicas R972, RY200, and RY300, respectively. As shown in TABLE 8, surface treatment with silica alone resulted in undesirably high 10-minute rebuilt charge-to-mass and desirably low dust levels. Treatment with titanium dioxide alone, as in Comparative Examples 17 and 18, in which the particles were surface treated with titanium dioxides T805 and MPT313, respectively, resulted in desirably low 10-minute rebuilt charge-to-mass but at the expense of undesirably high dust levels.

TABLE 8

Results of Measurements on Comparative Examples of Toners

| | FRESH | | | | | | Dust | REBUILT | | | | Dust |
|---|---|---|---|---|---|---|---|---|---|---|---|---|
| | Q/M ($\mu$C/g) | | | | | | 10 min | Q/M ($\mu$C/g) | | | | 10 min |
| Comparative Example | 2 min | % TC | 10 min | % TC | 1 h | % TC | mg | 2 min | % TC | 10 min | % TC | mg |
| 1 | −26.5 | 8.2 | −58.0 | 8.6 | −75.9 | 8.8 | 2.5 | −35.9 | 8.7 | −55.0 | 8.5 | 0.0 |
| 2 | −3.3 | 7.7 | −106.1 | 8.1 | −115.2 | 9.2 | 124.6 | −42.4 | 9.8 | −42.4 | 9.5 | 226.3 |
| 3 | −2.9 | 7.3 | −86.0 | 7.6 | −105.8 | 8.3 | 203.9 | −27.8 | 9.0 | −22.2 | 4.4 | 368.3 |
| 4 | −4.1 | 7.2 | −65.8 | 8.8 | −85.2 | 9.9 | 189.3 | −23.6 | 9.4 | −18.4 | 6.5 | 420.8 |
| 5 | −18.0 | 2.0 | −165.8 | 1.2 | −195.3 | 1.4 | 338.9 | −15.6 | 8.7 | −25.7 | 6.8 | 627.2 |
| 6 | −222.5 | 0.4 | −883.3 | 0.3 | −413.3 | 0.6 | 186.0 | −18.9 | 7.8 | −150.0 | 1.3 | 545.6 |
| 7 | −115.0 | 1.0 | −186.4 | 1.1 | −174.5 | 1.1 | 236.0 | −13.5 | 8.2 | −29.3 | 4.2 | 583.6 |
| 8 | −12.7 | 7.8 | −111.0 | 8.2 | −106.3 | 9.1 | 75.0 | −60.0 | 9.0 | −69.6 | 8.9 | 85.4 |
| 9 | −10.8 | 7.3 | −109.5 | 7.5 | −117.4 | 8.4 | 97.2 | −44.3 | 9.1 | −29.1 | 9.5 | 229.0 |
| 10 | −7.9 | 8.1 | −84.2 | 7.9 | −79.1 | 10.3 | 141.8 | −30.9 | 9.1 | −15.3 | 7.0 | 322.8 |
| 11 | −4.4 | 7.5 | −9.3 | 6.9 | −90.5 | 2.1 | 356.1 | −8.4 | 9.2 | −58.3 | 3.0 | 416.8 |
| 12 | −4.2 | 5.9 | −282.0 | 0.5 | −438.8 | 0.8 | 373.0 | −25.8 | 8.6 | −96.7 | 3.8 | 636.4 |
| 13 | −4.0 | 5.5 | −96.3 | 1.5 | −152.2 | 1.7 | 381.0 | −21.2 | 9.0 | −62.8 | 3.9 | 596.7 |
| 14 | −27.7 | 8.4 | −69.3 | 8.3 | −71.1 | 9.5 | 7.9 | −47.1 | 8.4 | −71.4 | 8.4 | 5.5 |
| 15 | −51.7 | 8 | −82.7 | 8.4 | −86.6 | 8.4 | 0.0 | −55.4 | 9.6 | −85.3 | 10.8 | 0.0 |
| 16 | −45.1 | 7.8 | −110.5 | 8.1 | −98.0 | 7.3 | 0.2 | −61.9 | 7.8 | −119.5 | 7.9 | 1.8 |

TABLE 8-continued

| Results of Measurements on Comparative Examples of Toners | | | | | | | | | | | | |
|---|---|---|---|---|---|---|---|---|---|---|---|---|
| | FRESH | | | | | | Dust | REBUILT | | | | Dust |
| | Q/M (μC/g) | | | | | | 10 min | Q/M (μC/g) | | | | 10 min |
| Comparative Example | 2 min | % TC | 10 min | % TC | 1 h | % TC | mg | 2 min | % TC | 10 min | % TC | mg |
| 17 | −6.4 | 8.1 | −56.2 | 7.8 | −69.1 | 7.9 | 184.1 | −8.3 | 8.2 | −35.8 | 7.9 | 181.6 |
| 18 | −13.5 | 7.6 | −9.4 | 7.7 | −54.9 | 7.3 | 268.1 | −13.8 | 8.0 | −26.7 | 8.1 | 115.1 |

Test results for developers corresponding to Inventive Examples 19–45, where the toner particles are treated with a mixture of silica and calcium stearate MCA-2, are given in TABLE 9. Similarly, test results for developers corresponding to Inventive Examples 46–72, where the toner particles are treated with a mixture of silica and zinc stearate MZN-2, are given in TABLE 10. By comparison to the results from Comparative Examples 1–18, the inclusion of increasing amounts of MCA-2 MZN-2 resulted in low rebuilt 10-minute charge-to-mass and dusting values. As shown in TABLES 9 and 10, highly desirable low 10-minute rebuilt charge-to-mass and dusting characteristics were seen particularly in Inventive Examples 25–27, 34–36, 43–45, 52–54, 61–63, and 72–74. In all of these examples, the toner particles were surface treated with a mixture of 1 wt. % of silica and 1.5–2 wt. % of either calcium stearate MCA-2 (Examples 25–27, 34–36, and 43–45) or zinc stearate MZN-2 (Examples 52–54, 61–63 and 70–72).

In Comparative Examples 73–82, the toner particles were surface treated with a mixture of titanium dioxide and calcium stearate MCA-2. As shown by the results in TABLE 11, developers formed from these toner compositions exhibited undesirably high rebuilt 10-minute dust levels, irrespective of the type of titanium dioxide used.

TABLE 9

| Results of Measurements on Inventive Examples of Toners | | | | | | | | | | | | |
|---|---|---|---|---|---|---|---|---|---|---|---|---|
| | FRESH | | | | | | Dust | REBUILT | | | | Dust |
| | Q/M (μC/g) | | | | | | 10 min | Q/M (μC/g) | | | | 10 min |
| Inventive Example | 2 min | % TC | 10 min | % TC | 1 h | % TC | mg | 2 min | % TC | 10 min | % TC | mg |
| 19 | −31.0 | 8.1 | −112.5 | 7.7 | −122.5 | 8.0 | 1.3 | −77.2 | 7.7 | −102.0 | 8.2 | 2 |
| 20 | −31.4 | 7.8 | −118.1 | 7.6 | −116.9 | 7.8 | 3.4 | −74.5 | 7.9 | −100.0 | 8.2 | 1.5 |
| 21 | −30.9 | 7.8 | −105.4 | 7.4 | −126.8 | 8.1 | 2.0 | −78.7 | 7.6 | −97.1 | 7.9 | 1.6 |
| 22 | −29.4 | 8.0 | −102.9 | 6.9 | −107.5 | 8.1 | 3.7 | −76.1 | 7.5 | −85.5 | 7.9 | 2.1 |
| 23 | −13.2 | 7.4 | −17.9 | 8.1 | −7.6 | 7.7 | 15.2 | −60.9 | 7.9 | −31.4 | 7.8 | 8.2 |
| 24 | −22.5 | 7.7 | −30.9 | 7.8 | −29.3 | 7.5 | 13.5 | −63.1 | 8.0 | −36.9 | 8.1 | 5.9 |
| 25 | −27.7 | 7.7 | −35.2 | 7.9 | −35.1 | 8.0 | 6.3 | −73.6 | 7.3 | −43.6 | 7.8 | 3.2 |
| 26 | −23.6 | 7.6 | −16.5 | 7.9 | −16.3 | 7.6 | 9.0 | −65.4 | 7.9 | −25.0 | 9.0 | 8.2 |
| 27 | −21.1 | 7.8 | −8.6 | 7.8 | −9.6 | 8.3 | 20.9 | −64.9 | 7.9 | −21.5 | 8.1 | 10.8 |
| 28 | −42.9 | 7.9 | −84.1 | 7.2 | −105.3 | 7.6 | 2.0 | −63.5 | 7.5 | −110.8 | 6.9 | 0.0 |
| 29 | −42.7 | 8.0 | −114.1 | 7.4 | −119.0 | 7.8 | 3.2 | −80.6 | 8.0 | −105.2 | 9.0 | 0.0 |
| 30 | −34.9 | 8.1 | −108.9 | 7.1 | −114.2 | 6.8 | 0.0 | −78.4 | 7.7 | −117.2 | 7.1 | 0.0 |
| 31 | −38.8 | 8.0 | −105.5 | 7.2 | −105.5 | 7.1 | 0.0 | −79.6 | 7.7 | −99.9 | 7.9 | 0.0 |
| 32 | −50.9 | 7.9 | −91.7 | 8.1 | −83.8 | 9.9 | 0.0 | −74.2 | 10.6 | −64.6 | 11.6 | 0.0 |
| 33 | −39.8 | 8.1 | −69.0 | 7.9 | −58.7 | 8.3 | 3.2 | −93.2 | 7.4 | −71.7 | 8.0 | 1.2 |
| 34 | −49.0 | 7.7 | −45.5 | 8.1 | −38.1 | 8.3 | 0.0 | −90.6 | 7.8 | −64.0 | 8.4 | 0.0 |
| 35 | −36.6 | 7.9 | −19.0 | 8.1 | −5.2 | 9.1 | 3.9 | −106.4 | 7.2 | −50.1 | 8.3 | 2.5 |
| 36 | −37.9 | 7.7 | −19.0 | 7.8 | −5.6 | 6.6 | 0.0 | −96.7 | 7.1 | −44.4 | 7.8 | 0.0 |
| 37 | −37.7 | 8.2 | −113.6 | 7.8 | −129.3 | 7.0 | 0.0 | −63.9 | 8.3 | −116.0 | 9.0 | 0.0 |
| 38 | −41.1 | 8.1 | −115.2 | 7.7 | −122.3 | 7.6 | 0.0 | −83.8 | 8.4 | −110.8 | 8.8 | 0.0 |
| 39 | −40.0 | 8.1 | −112.8 | 7.6 | −122.1 | 7.2 | 1.5 | −75.4 | 8.0 | −115.1 | 7.8 | 0.0 |
| 40 | −38.8 | 8.1 | −109.2 | 7.1 | −100.7 | 7.3 | 0.0 | −93.6 | 7.3 | −102.9 | 7.9 | 0.0 |
| 41 | −38.2 | 8.1 | −104.9 | 7.4 | −102.2 | 7.2 | 0.0 | −94.3 | 7.9 | −92.5 | 8.1 | 0.0 |
| 42 | −42.6 | 7.7 | −85.1 | 7.4 | −84.9 | 7.2 | 2.6 | −97.4 | 7.4 | −87.6 | 8.2 | 0.4 |
| 43 | −38.3 | 7.7 | −56.5 | 7.9 | −47.7 | 7.8 | 1.0 | −105.1 | 6.9 | −46.7 | 8.0 | 0.0 |
| 44 | −33.3 | 7.8 | −26.6 | 7.9 | −9.2 | 7.5 | 3.7 | −108.8 | 7.2 | −35.9 | 8.3 | 1.0 |
| 45 | −28.5 | 8.0 | −15.3 | 7.5 | −7.3 | 7.1 | 4.9 | −99.2 | 7.2 | −26.5 | 8.0 | 2.3 |

TABLE 10

Results of Measurements on Inventive Examples of Toners

| | FRESH | | | | | | Dust | REBUILT | | | | Dust |
|---|---|---|---|---|---|---|---|---|---|---|---|---|
| | Q/M (μC/g) | | | | | | 10 min | Q/M (μC/g) | | | | 10 min |
| Comparative Example | 2 min | % TC | 10 min | % TC | 1 h | % TC | mg | 2 min | % TC | 10 min | % TC | mg |
| 46 | −29.1 | 7.8 | −116.7 | 7.5 | −115.0 | 8.0 | 2.4 | −60.8 | 7.8 | −107.7 | 7.8 | 1.2 |
| 47 | −37.5 | 7.6 | −90.1 | 7.1 | −113.6 | 7.2 | 1.2 | −86.5 | 7.3 | −102.1 | 7.5 | 1.0 |
| 48 | −32.7 | 7.7 | −111.4 | 7.0 | −116.8 | 7.6 | 0.3 | −86.9 | 7.1 | −92.9 | 8.0 | 0.0 |
| 49 | −32.4 | 8.0 | −98.6 | 7.2 | −96.1 | 7.2 | 1.0 | −92.3 | 6.9 | −78.6 | 8.1 | 1.1 |
| 50 | −37.7 | 7.7 | −88.5 | 7.3 | −94.7 | 7.0 | 1.5 | −98.4 | 7.6 | −73.5 | 8.3 | 2.7 |
| 51 | −36.8 | 7.7 | −54.0 | 8.1 | −51.6 | 7.7 | 3.9 | −104.9 | 6.6 | −46.9 | 8.1 | 4.6 |
| 52 | −35.3 | 7.8 | −29.8 | 8.3 | −26.9 | 7.7 | 8.3 | −98.5 | 7.0 | −49.9 | 8.0 | 6.2 |
| 53 | −30.1 | 8.1 | −17.0 | 8.3 | −9.1 | 7.7 | 18.6 | −105.1 | 7.1 | −38.6 | 7.8 | 5.0 |
| 54 | −28.9 | 7.1 | −8.6 | 6.9 | −18.1 | 3.5 | 56.6 | −104.5 | 7.3 | −23.3 | 7.9 | 7.0 |
| 55 | −42.9 | 7.9 | −84.1 | 7.2 | −105.3 | 7.6 | 2.0 | −63.5 | 7.5 | −110.8 | 6.9 | 0.0 |
| 56 | −42.7 | 8.0 | −114.1 | 7.4 | −119.0 | 7.8 | 3.2 | −80.6 | 8.0 | −105.2 | 9.0 | 0.0 |
| 57 | −34.9 | 8.1 | −108.9 | 7.1 | −114.2 | 6.8 | 0.0 | −78.4 | 7.7 | −117.2 | 7.1 | 0.0 |
| 58 | −38.8 | 8.0 | −105.5 | 7.2 | −105.5 | 7.1 | 0.0 | −79.6 | 7.7 | −99.9 | 7.9 | 0.0 |
| 59 | −50.9 | 7.9 | −91.7 | 8.1 | −83.8 | 9.9 | 0.0 | −74.2 | 10.6 | −64.6 | 11.6 | 0.0 |
| 60 | −39.8 | 8.1 | −69.0 | 7.9 | −58.7 | 8.3 | 3.2 | −93.2 | 7.4 | −71.7 | 8.0 | 1.2 |
| 61 | −49.0 | 7.7 | −45.5 | 8.1 | −38.1 | 8.3 | 0.0 | −90.6 | 7.8 | −64.0 | 8.4 | 0.0 |
| 62 | −36.6 | 7.9 | −19.0 | 8.1 | −5.2 | 9.1 | 3.9 | −106.4 | 7.2 | −50.1 | 8.3 | 2.5 |
| 63 | −37.9 | 7.7 | −19.0 | 7.8 | −5.6 | 6.6 | 0.0 | −96.7 | 7.1 | −44.4 | 7.8 | 0.0 |
| 64 | −37.7 | 8.2 | −113.6 | 7.8 | −129.3 | 7.0 | 0.0 | −63.9 | 8.3 | −116.0 | 9.0 | 0.0 |
| 65 | −41.1 | 8.1 | −115.2 | 7.7 | −122.3 | 7.6 | 0.0 | −83.8 | 8.4 | −110.8 | 8.8 | 0.0 |
| 66 | −40.0 | 8.1 | −112.8 | 7.6 | −122.1 | 7.2 | 1.5 | −75.4 | 8.0 | −115.1 | 7.8 | 0.0 |
| 67 | −38.8 | 8.1 | −109.2 | 7.1 | −100.7 | 7.3 | 0.0 | −93.6 | 7.3 | −102.9 | 7.9 | 0.0 |
| 68 | −38.2 | 8.1 | −104.9 | 7.4 | −102.2 | 7.2 | 0.0 | −94.3 | 7.9 | −92.5 | 8.1 | 0.0 |
| 69 | −42.6 | 7.7 | −85.1 | 7.4 | −84.9 | 7.2 | 2.6 | −97.4 | 7.4 | −87.6 | 8.2 | 0.4 |
| 70 | −38.3 | 7.7 | −56.5 | 7.9 | −47.7 | 7.8 | 1.0 | −105.1 | 6.9 | −46.7 | 8.0 | 0.0 |
| 71 | −33.3 | 7.8 | −26.6 | 7.9 | −9.2 | 7.5 | 3.7 | −108.8 | 7.2 | −35.9 | 8.3 | 1.0 |
| 72 | −28.5 | 8.0 | −15.3 | 7.5 | −7.3 | 7.1 | 4.9 | −99.2 | 7.2 | −26.5 | 8.0 | 2.3 |

TABLE 11

Results of Measurements on Comparative Examples of Toners

| | FRESH | | | | | | Dust | REBUILT | | | | Dust |
|---|---|---|---|---|---|---|---|---|---|---|---|---|
| | Q/M (μC/g) | | | | | | 10 min | Q/M (μC/g) | | | | 10 min |
| Comparative Example | 2 min | % TC | 10 min | % TC | 1 h | % TC | mg | 2 min | % TC | 10 min | % TC | mg |
| 73 | −4.4 | 7.7 | −80.8 | 7.7 | −103.5 | 8.2 | 133.1 | −19.5 | 8.6 | −34.8 | 8.6 | 12.8 |
| 74 | −3.1 | 7.6 | −27.2 | 8.0 | −79.9 | 7.5 | 23.0 | −25.2 | 8.1 | −18.4 | 8.0 | 11.6 |
| 75 | −3.2 | 7.5 | −10.4 | 8.0 | −11.9 | 6.8 | 33.4 | −24.4 | 8.3 | −17.5 | 8.0 | 21.9 |
| 76 | −2.8 | 7.7 | −3.4 | 7.1 | −5.5 | 5.5 | 195.5 | −28.0 | 8.0 | −13.1 | 8.1 | 72.6 |
| 77 | −2.7 | 7.2 | −1.9 | 6.8 | −1.9 | 6.5 | 296.8 | −28.1 | 7.4 | −13.3 | 8.0 | 33.1 |
| 78 | −13.8 | 7.3 | −13.9 | 8.0 | −35.5 | 7.6 | 215.1 | −23.9 | 8.0 | −11.6 | 8.0 | 260.4 |
| 79 | −13.1 | 8.3 | −6.5 | 7.8 | −7.5 | 7.8 | 297.8 | −32.1 | 8.1 | −7.5 | 8.1 | 303.1 |
| 80 | −14.0 | 8.0 | −4.1 | 7.1 | −176.3 | 0.8 | 354.6 | −34.6 | 7.7 | −11.6 | 7.9 | 307.6 |
| 81 | −12.4 | 7.5 | −4.2 | 7.2 | −213.3 | 0.6 | 360.1 | −32.2 | 6.9 | −12.0 | 9.0 | 361.0 |
| 82 | −13.2 | 7.8 | −2.2 | 6.3 | −2.4 | 3.3 | 358.1 | −34.7 | 7.7 | −13.7 | 7.4 | 309.6 |

Toner compositions of the present invention are suitable for use in subtractive color processes. Colorants incorporated in the polymeric toner particles can be of a subtractive primary color selected from the group consisting of cyan, yellow, magenta, and black. Useful colorants for this purpose include copper phthalocyanine, Pigment Blue 61, lithol rubine, quinacridone, diarylide yellow, and carbon.

The invention has been described in detail with particular reference to certain preferred embodiments thereof, but it will be understood that variations and modifications can be effected within the spirit and scope of the invention, which is defined by the following claims.

What is claimed is:

1. An electrostatographic toner composition consisting essentially of:

noncrosslinked linear polymeric toner particles;

about 0.7 wt. % to about 4 wt. % of hydrophobic silica particles disposed on the surface of said toner particles; and about 0.1 wt. % to about 2 wt. % of particles of a fatty acid metal salt having an average particle size of 0.5 μm to 1.5 μm disposed on the surface of said toner particles, said metal salt being a calcium salt or a zinc salt, wherein the weight percentages of said hydrophobic silica particles and said particles of a fatty acid metal salt are based on the weight of said polymeric toner particles.

2. The toner composition of claim 1 containing about 1 wt. % to about 2 wt. % of particles of said hydrophobic silica particles.

3. The toner composition of claim 2 containing about 1 wt. % of said hydrophobic silica particles.

4. The toner composition of claim 1 containing about 0.5 wt. % to about 2 wt. % of particles of said fatty acid metal salt.

5. The toner composition of claim 4 containing about 1 wt. % to about 2 wt. % of particles of said fatty acid metal salt.

6. The toner composition of claim 1 wherein said hydrophobic silica particles have a particle size of about 0.005 μm (5 nm) to about 0.05 μm (50 nm).

7. The toner composition of claim 6, wherein said hydrophobic silica particles have a surface area of about 30 $m^2/g$ to about 450 $m^2/g$.

8. The toner composition of claim 6 wherein said hydrophobic silica particles have an average particle size of 0.006 μm (6 nm) to 0.018 μm (18 nm).

9. The toner composition of claim 6 wherein said hydrophobic silica particles are selected from the group consisting of R972 silica, RY200 silica, and RY300 silica.

10. The toner composition of claim 1 wherein said fatty acid metal salt is calcium stearate.

11. The toner composition of claim 10 wherein said calcium stearate has an average particle size of 0.5 μm to 1 μm.

12. The toner composition of claim 1 wherein said polymeric toner particles comprise a binder polymer selected from the group consisting of polyesters and vinyl addition polymers.

13. The toner composition of claim 12 wherein said binder polymer is a bis-phenol A based polyester.

14. The toner composition of claim 1 wherein said toner particles have a volume-average particle size of about 2 μm to about 20 μm.

15. The toner composition of claim 14 wherein said toner particles have a volume-average particle size of about 4 μm to about 10 μm.

16. The toner composition of claim 15 wherein said toner particles have a volume-average particle size of about 7.8 μm to about 8.5 μm.

17. The toner composition of claim 14 wherein said toner particles have a BET surface area of about 0.4 $m^2/g$ to about 20 $m^2/g$.

18. The toner composition of claim 1 wherein said toner particles further contain a colorant.

19. The toner composition of claim 18 wherein said colorant comprises a subtractive primary color selected from the group consisting of cyan, yellow, magenta, and black.

20. The toner composition of claim 18 wherein said colorant is selected from the group consisting of copper phthalocyanine, Pigment Blue 61, lithol rubine, quinacridone, diarylide yellow, and carbon.

21. The toner composition of claim 1 wherein said toner particles further contain a charge control agent.

22. An electrostatographic developer comprising hard magnetic carrier particles and the toner composition of claim 1.

23. The developer of claim 22 wherein said carrier particles are hard magnetic ferrite particles coated with an insulating resin.

24. The developer of claim 22 comprising about 80 wt. % to about 98 wt. % of said carrier particles and about 20 wt. % to about 2 wt. % of said toner composition.

25. The developer of claim 24 comprising about 92 wt. % of said carrier particles and about 8 wt. % of said toner composition.

26. The developer of claim 22 having a resistivity of about $10^{12}$ ohm-cm to about $10^{15}$ ohm-cm.

27. The developer of claim 26 having a resistivity of about $10^{14}$ ohm-cm to about $10^{15}$ ohm-cm.

28. The toner composition of claim 1 wherein said fatty acid metal salt is zinc stearate.

29. The toner composition of claim 28 wherein said zinc stearate has an average particle size of 0.7 μm to 1.5 μm.

30. A process for forming an electrostatographic toner composition comprising:

providing noncrosslinked linear polymeric toner particles of a selected particle size; and dry blending said polymeric toner particles with a mixture consisting essentially of about 0.7 wt. % to about 4 wt. % of hydrophobic silica particles and about 0.1 wt. % to about 2 wt. % of particles of a fatty acid metal salt having an average particle size of 0.5 μm to 1.5 μm, said metal salt being a calcium salt or a zinc salt, the weight percentages of said hydrophobic silica particles and said particles of a fatty acid metal salt being based on the weight of said polymeric toner particles, thereby forming a toner composition wherein said hydrophobic silica particles and particles of a fatty acid metal salt are disposed on the surface of said toner particles.

31. The process of claim 30 wherein said toner composition contains about 1 wt. % to about 2 wt. % of particles of said hydrophobic silica particles.

32. The process of claim 31 wherein said toner composition contains about 1 wt. % of said hydrophobic silica particles.

33. The process of claim 30 wherein said toner composition contains about 0.5 wt. % to about 2 wt. % of particles of said fatty acid metal salt.

34. The process of claim 33 wherein said toner composition contains about 1 wt. % to about 2 wt. % of particles of said fatty acid metal salt.

35. The process of claim 30 wherein said dry blending is carried out using a high-speed mixer.

36. The process of claim 30 wherein said toner particles have a volume-average particle size of about 2 μm to about 20 μm.

37. The process of claim 30 wherein said hydrophobic silica particles have a volume-average particle size of about 0.005 μm 5 nm) to about 0.05 μm (50 nm).

38. The process of claim 30 wherein said fatty acid metal salt is calcium stearate.

39. The process of claim 30 wherein said polymeric toner particles comprise a binder polymer selected from the group consisting of polyesters and vinyl addition polymers.

40. The process of claim 39 wherein said binder polymer is a bis-phenol A based polyester.

41. The process of claim 30 wherein said polymeric toner particles contain a colorant.

42. The process of claim 41 wherein said colorant comprises a subtractive primary color selected from the group consisting of cyan, yellow, magenta, and black.

43. The process of claim 30 wherein said polymeric toner particles contain a charge control agent.

44. The process of claim 30 wherein said hydrophobic silica particles have an average particle size of 0.006 μm (6 nm) to 0.018 μm (18 nm).

45. The process of claim 30 wherein said fatty acid metal salt is zinc stearate.

* * * * *